US007712459B2

(12) United States Patent
Ishii et al.

(10) Patent No.: US 7,712,459 B2
(45) Date of Patent: May 11, 2010

(54) AIR-FUEL RATIO CONTROL SYSTEM FOR INTERNAL COMBUSTION ENGINE AND CONTROL METHOD OF THE SAME

(75) Inventors: Ryo Ishii, Susono (JP); Norihisa Nakagawa, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/225,930

(22) PCT Filed: Apr. 23, 2007

(86) PCT No.: PCT/IB2007/001048

§ 371 (c)(1),
(2), (4) Date: Oct. 2, 2008

(87) PCT Pub. No.: WO2007/122492

PCT Pub. Date: Nov. 1, 2007

(65) Prior Publication Data

US 2009/0173323 A1 Jul. 9, 2009

(30) Foreign Application Priority Data

Apr. 24, 2006 (JP) ..... 2006-119311

(51) Int. Cl.
*F02D 41/00* (2006.01)

(52) U.S. Cl. ..... 123/685; 701/103

(58) Field of Classification Search ..... 123/685, 123/694, 696; 701/102, 106, 109, 110, 112, 701/113; 60/278, 279, 276, 299, 258, 605.02
See application file for complete search history.

(56) References Cited

U.S. PATENT DOCUMENTS 5,095,878 A 3/1992 Kumagai et al.
5,832,724 A 11/1998 Watanabe et al.

(Continued)

FOREIGN PATENT DOCUMENTS

JP A-05-052140 3/1993

(Continued)

OTHER PUBLICATIONS

Nov. 26, 2009 Office Action issued in Japanese patent application No. 2006-119311 (with translation).

*Primary Examiner*—Stephen K Cronin
*Assistant Examiner*—Johnny H Hoang
(74) *Attorney, Agent, or Firm*—Oliff & Berridge, PLC

(57) ABSTRACT

An air-fuel ratio control system includes an air-fuel ratio sensor (23, 24) disposed upstream or downstream of an exhaust purification catalyst, and performs feedback control of the fuel supply amount such that an output value of the air-fuel ratio sensor is controlled to the target air-fuel ratio. The feedback control is performed by calculating a correction amount by summing up the value of a proportional and the value of an integral calculated based on the deviation between the output value of the air-fuel ratio sensor and the target air-fuel ratio, and correcting the fuel supply amount based on the obtained correction amount. At cold startup of the internal combustion engine, the value of the integral is set to be a smaller value from the startup of the internal combustion engine until a predetermined period elapses.

12 Claims, 13 Drawing Sheets

U.S. PATENT DOCUMENTS

| | | | | |
|---|---|---|---|---|
| 6,035,839 | A | 3/2000 | Ohtani et al. | |
| 6,210,641 | B1 * | 4/2001 | Yamada et al. | 422/94 |
| 6,325,056 | B1 * | 12/2001 | Weining et al. | 123/673 |
| 6,453,229 | B1 * | 9/2002 | Ohkuma et al. | 701/109 |
| 6,769,422 | B2 * | 8/2004 | Ohkuma | 123/696 |
| 7,225,800 | B2 * | 6/2007 | Nakagawa et al. | 123/673 |
| 7,284,545 | B2 * | 10/2007 | Rosel et al. | 123/673 |

FOREIGN PATENT DOCUMENTS

| | | |
|---|---|---|
| JP | A-07-071304 | 3/1995 |
| JP | A-07-332135 | 12/1995 |
| JP | A-08-261042 | 10/1996 |
| JP | A-2000-265885 | 9/2000 |
| JP | A-2001-234786 | 8/2001 |
| JP | A-2002-138821 | 5/2002 |
| JP | A-2003-003891 | 1/2003 |
| JP | A-2005-325717 | 11/2005 |
| JP | A-2007-120326 | 5/2007 |

* cited by examiner

AIR-FUEL RATIO CONTROL SYSTEM FOR INTERNAL COMBUSTION ENGINE AND CONTROL METHOD OF THE SAME

FIELD OF THE INVENTION

The present invention relates to an air-fuel ratio control system for an internal combustion engine and a control method of the same.

BACKGROUND OF THE INVENTION

Internal combustion engines discharge exhaust gas containing components such as hydrocarbons (HC), carbon monoxide (CO), and nitrogen oxides ($NO_x$). Three-way catalysts are used to purify such components. The purification performance of such three-way catalysts are higher when the air-fuel ratio of the exhaust gas (hereinafter referred to as "exhaust air-fuel ratio") is maintained approximately at the stoichiometric air-fuel ratio. Thus, to purify exhaust gas using a three-way catalyst, it is necessary to control the amount of fuel to be supplied to the combustion chamber and other parameter, so as to bring the exhaust air-fuel ratio to approximately the stoichiometric air-fuel ratio.

For this purpose, most internal combustion engines are provided with an air-fuel ratio sensor disposed in an engine exhaust passage and upstream of the three-way catalyst to detect the exhaust air-fuel ratio. The amount of fuel to be supplied to the combustion chamber is controlled so as to bring the exhaust air-fuel ratio detected by the air-fuel ratio sensor to approximately the stoichiometric air-fuel ratio by feedback (F/B) control (hereinafter referred to as "main F/B control").

Disposed upstream of the three-way catalyst, however, the air-fuel ratio sensor may produce unstable outputs due to nonuniform exhaust gas, or may be deteriorated by the heat of the exhaust gas. Thus, the air-fuel ratio sensor may be unable to accurately detect the actual air-fuel ratio. In such a case, the control precision of the air-fuel ratio by the main F/B control described above is lowered.

With this in view, so-called "double sensor systems" have already been in practical use. The double sensor systems are provided with an additional air-fuel ratio sensor disposed also in the engine exhaust gas passage but downstream of the three-way catalyst to detect the exhaust air-fuel ratio. The double sensor systems can improve the control precision of the air-fuel ratio sensor by performing sub-F/B control, which corrects an output value of the upstream air-fuel ratio sensor (and consequently the fuel supply amount) based on an output of the downstream air-fuel ratio sensor such that the output value of the upstream air-fuel ratio sensor coincides with the actual air-fuel ratio.

At cold startup of an internal combustion engine, for example, startup fuel amount increase control is performed in which the fuel supply amount is increased compared to that when the internal combustion engine is in normal operation, in order to stabilize the combustion of an air-fuel mixture in a combustion chamber. During the startup fuel amount increase control, the fuel supply amount is adjusted and the air-fuel ratio is subjected to open control. After the startup fuel amount increase control is finished, F/B control is performed.

In this case, however, the F/B control is not started until the startup fuel amount increase control is finished, which requires a longer time since the startup of the internal combustion engine until the start of the F/B control. The exhaust air-fuel ratio often does not achieve the target air-fuel ratio before the start of the F/B control, which adversely affects the exhaust emission. Therefore, it is required that the F/B control is started immediately after the cold startup of the internal combustion engine.

JP-A-2003-3891 discloses an air-fuel ratio control system that starts F/B control so as to bring the actual exhaust air-fuel ratio to the target air-fuel ratio and reduces the proportion at which the increase in fuel supply amount due to startup fuel amount increase control is reduced when the engine operating condition satisfies a predetermined condition, even before the startup fuel amount increase control is finished. This system allows immediate start of F/B control and a smooth shift from open control to F/B control.

In the double sensor systems described above, both the main F/B control and the sub-F/B control employ PID control or PI control. In the PID control and the PI control, the value of a proportional and the value of an integral (and the value of a differential in the case of the PID control) are calculated based on the deviation between an output value of the air-fuel ratio sensor and the target air-fuel ratio, the obtained values of the proportional and integral are summed up to calculate a correction amount, and the fuel supply amount and an output value of the upstream air-fuel ratio sensor are corrected based on the obtained correction amount.

The value of the integral is proportional to the integral of the deviation between the output value of the air-fuel ratio sensor and the target air-fuel ratio from the start of the F/B control. Here, the deviation between the output value of the air-fuel ratio sensor and the target air-fuel ratio is large because of the increase in fuel amount during the startup fuel amount increase control. Thus, if the F/B control is started before the startup fuel amount increase control is finished, the value of the integral is calculated based on the large deviation, which causes the value of the integral after the startup fuel amount increase control is finished to greatly deviate from an appropriate value.

DISCLOSURE OF THE INVENTION

An object of the present invention is to provide an air-fuel ratio control system for an internal combustion engine that performs F/B control while still performing fuel amount increase control and that yet prevents the value of an integral for PI control or other controls, from greatly deviating from an appropriate value after the amount increase control is finished.

A first aspect of the present invention is directed to an air-fuel ratio control system for an internal combustion engine. The air-fuel ratio control system for an internal combustion engine includes an air-fuel ratio sensor disposed upstream or downstream of an exhaust purification catalyst provided in an engine exhaust passage to detect an air-fuel ratio of exhaust gas, and performs feedback control of a fuel supply amount such that an output value of the air-fuel ratio sensor is controlled to a target air-fuel ratio. The feedback control is performed by calculating a correction amount by summing up the value of a proportional and the value of an integral calculated based on the deviation between the output value of the air-fuel ratio sensor and the target air-fuel ratio, and correcting the fuel supply amount based on the obtained correction amount. In addition, at cold startup of the internal combustion engine, from the startup of the internal combustion engine until a predetermined period elapses, the feedback control sets the value of the integral term calculated based on the deviation to a value smaller than the value of the integral term calculated based on the same deviation during normal operation. The predetermined period is longer than a period from the cold startup of the internal combustion engine until the air-fuel ratio sensor is activated.

At cold startup of the internal combustion engine, startup fuel amount increase control may be performed in which the fuel supply amount is increased compared to that during normal operation. The predetermined period may be longer than a period from the cold startup until the startup fuel amount increase control is finished.

A second aspect of the present invention is also directed to an air-fuel ratio control system for an internal combustion engine. The air-fuel ratio control system for an internal combustion engine includes an air-fuel ratio sensor disposed upstream or downstream of an exhaust purification catalyst provided in an engine exhaust passage to detect an air-fuel ratio of exhaust gas, performs feedback control of a fuel supply amount such that an output value of the air-fuel ratio sensor is controlled to a target air-fuel ratio, and performs fuel amount increase control in which an amount of fuel to be supplied to the internal combustion engine is increased compared to that when the internal combustion engine is in normal operation according to an engine operating condition. The feedback control is performed by calculating a correction amount by summing up a value of a proportional and a value of an integral calculated based on a deviation between the output value of the air-fuel ratio sensor and the target air-fuel ratio, and correcting the fuel supply amount based on the obtained correction amount. From start of the fuel amount increase control until a predetermined period elapses, the value of the integral calculated based on the deviation is set to a value smaller than the value of the integral calculated based on the same deviation during normal operation.

In the second aspect of the present invention, the predetermined period may be longer than a period from start to finish of the amount increase control.

In each aspect of the present invention, the value smaller than the value of the integral calculated during normal operation may be zero.

The predetermined period may be varied according to an integrated intake air amount.

While the value of the integral calculated based on the deviation is set to a value smaller than the value of the integral calculated based on the same deviation during normal operation, the value of the proportional calculated based on the deviation may be the same as the value of the proportional calculated based on the same deviation during normal operation.

A third aspect of the invention is directed to a control method of an air-fuel ratio control system for an internal combustion engine. The control method is directed to an air-fuel ratio control system for an internal combustion engine that includes an air-fuel ratio sensor disposed upstream or downstream of an exhaust purification catalyst provided in an engine exhaust passage to detect an air-fuel ratio of exhaust gas, and that performs feedback control of a fuel supply amount such that an output value of the air-fuel ratio sensor is controlled to a target air-fuel ratio. The feedback control includes the steps of: calculating a correction amount by summing up a value of a proportional and a value of an integral calculated based on a deviation between the output value of the air-fuel ratio sensor and the target air-fuel ratio, and correcting the fuel supply amount based on the obtained correction amount; and at cold startup of the internal combustion engine, from the startup of the internal combustion engine until a predetermined period elapses, setting the value of the integral calculated based on the deviation to a value smaller than the value of the integral calculated based on the same deviation during normal operation, the predetermined period being longer than a period from the startup of the internal combustion engine until the air-fuel ratio sensor is activated.

A fourth aspect of the invention is directed to a control method of an air-fuel ratio control system for an internal combustion engine. The control method is directed to an air-fuel ratio control system for an internal combustion engine that includes an air-fuel ratio sensor disposed upstream or downstream of an exhaust purification catalyst provided in an engine exhaust passage to detect an air-fuel ratio of exhaust gas, that performs feedback control of a fuel supply amount such that an output value of the air-fuel ratio sensor is controlled to a target air-fuel ratio, and that performs fuel amount increase control in which an amount of fuel to be supplied to the internal combustion engine is increased compared to that when the internal combustion engine is in normal operation according to an engine operating condition. The feedback control includes the steps of: calculating a correction amount by summing up a value of a proportional and a value of an integral calculated based on a deviation between the output value of the air-fuel ratio sensor and the target air-fuel ratio, and correcting the fuel supply amount based on the obtained correction amount; and from start of the amount increase control until a predetermined period elapses, setting the value of the integral calculated based on the deviation to a value smaller than that calculated based on the same deviation during normal operation.

Each aspect of the present invention can provide an air-fuel ratio control system for an internal combustion engine that performs F/B control while still performing fuel amount increase control and that yet prevents the value of an integral term for PI control, etc., from greatly deviating from an appropriate value after the amount increase control is finished.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
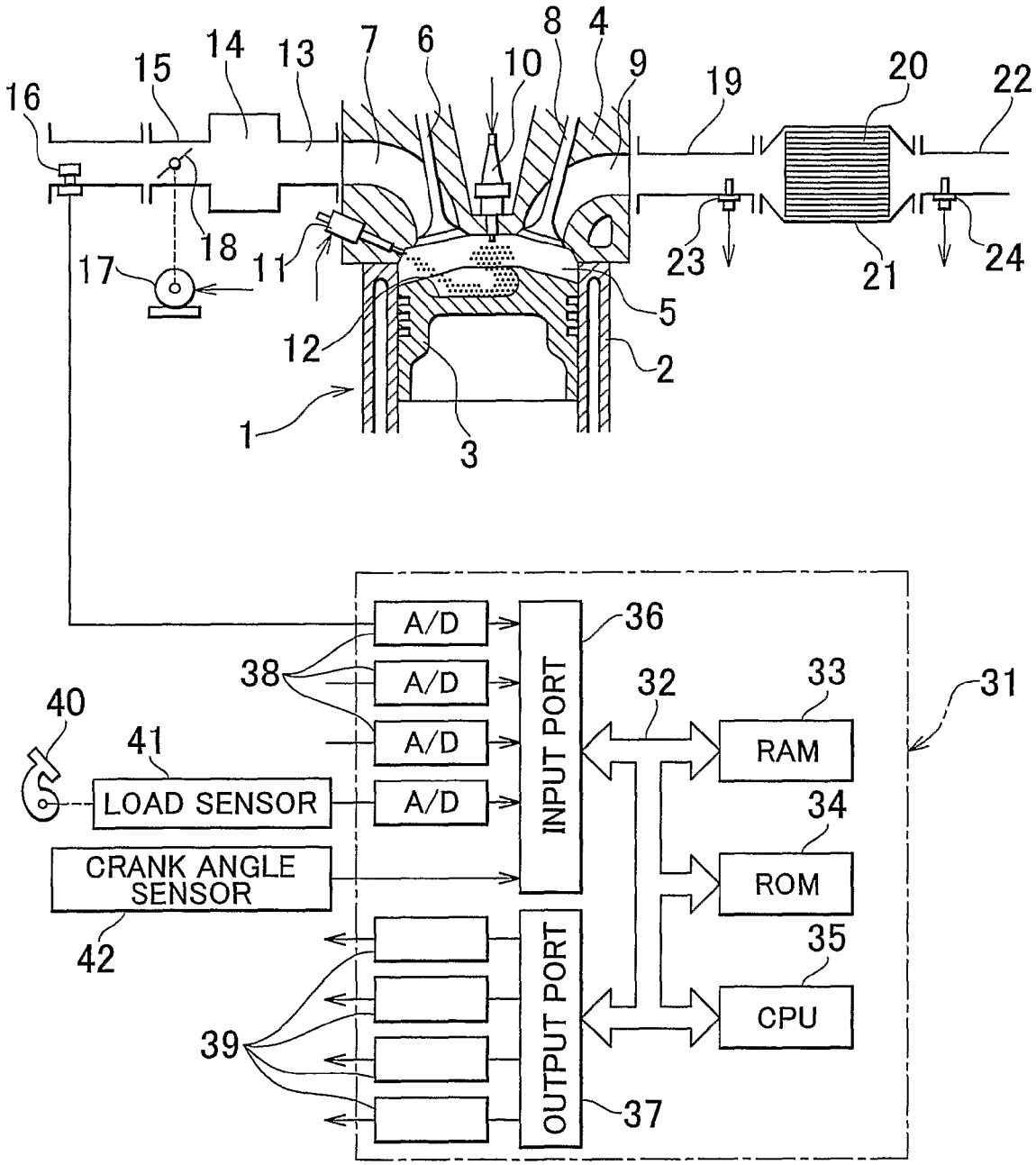
FIG. 1 shows an entire internal combustion engine to which an air-fuel ratio control system for an internal combustion engine of the present invention is applied.

A description will hereinafter be made of an air-fuel ratio control system for an internal combustion engine of a first embodiment of the present invention with reference to the drawings. FIG. 1 shows the entire internal combustion engine having the air-fuel ratio control system of the present invention. In the embodiment shown in FIG. 1, the air-fuel ratio control system of the present invention is used for an in-cylinder direct-injection, spark ignition internal combustion engine. However, the system may be used for other types of spark ignition internal combustion engines as well.

With reference to FIG. 1, reference numerals respectively denotes an engine main body 1, a cylinder block 2, a piston 3 for reciprocation within the cylinder block 2, a cylinder head 4 secured on top of the cylinder block 2, a combustion chamber 5 defined between the piston 3 and the cylinder head 4, an intake valve 6, an intake port 7, an exhaust valve 8, and an exhaust port 9. As shown in FIG. 1, an ignition plug 10 is disposed at the center of the inner wall surface of the cylinder head 4, and a fuel injection valve 11 is disposed at the periphery of the inner wall surface of the cylinder head 4. On the top surface of the piston 3, a cavity 12 is formed from the position under the fuel injection valve 11 to the position under the ignition plug 10.

The intake port 7 of each cylinder is coupled via a corresponding intake branch pipe 13 to a surge tank 14, which is coupled via an intake pipe 15 to an air cleaner (not shown). An air flow meter 16 and a throttle valve 18 driven by a step motor 17 are disposed in the intake pipe 15. Meanwhile, the exhaust port 9 of each cylinder is coupled to an exhaust manifold 19, which is coupled to a catalytic converter 21 with a built-in three-way catalyst (exhaust purification catalyst) 20. The outlet of the catalytic converter 21 is coupled to an exhaust pipe 22. An air-fuel ratio sensor 23 is disposed in the exhaust manifold 19, that is, in an exhaust passage upstream of the three-way catalyst 20. An oxygen sensor 24 is disposed in the exhaust pipe 22, that is, in an exhaust passage downstream of the three-way catalyst 20.

Figure 2:
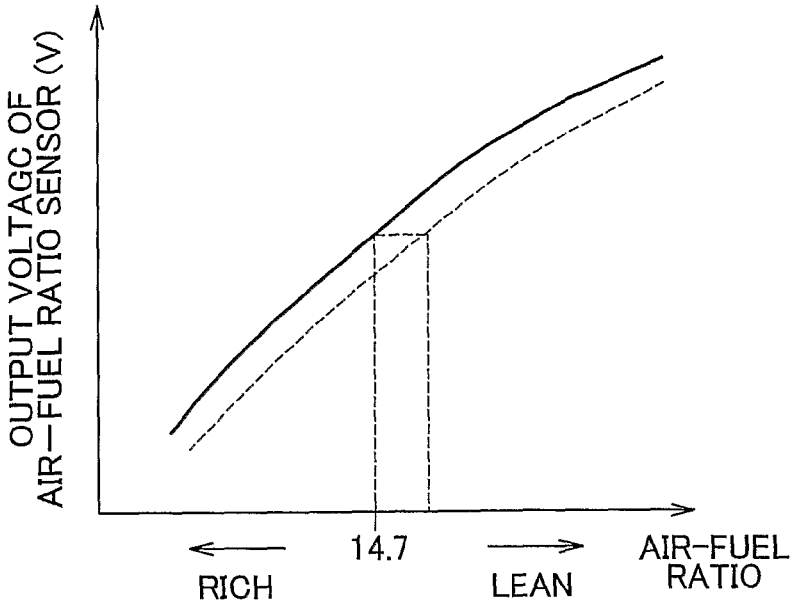
FIG. 2 shows the relationship between the exhaust air-fuel ratio and the output voltage of an air-fuel ratio sensor.
Figure 3:
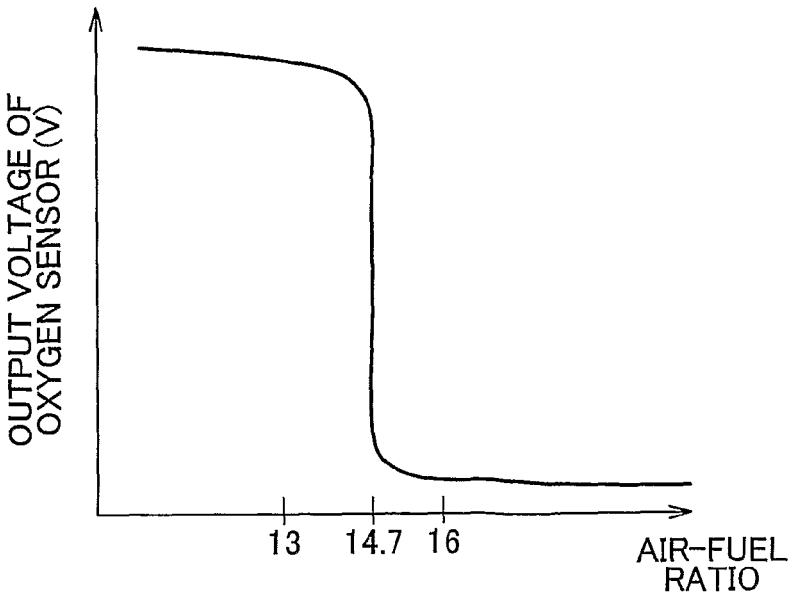
FIG. 3 shows the relationship between the exhaust air-fuel ratio and the output voltage of an oxygen sensor.

An electronic control unit 31 is constituted of a digital computer including a RAM (random access memory) 33, a ROM (read only memory) 34, a CPU (microprocessor) 35, an input port 36, and an output port 37 interconnected via a bi-directional bus 32. The air flow meter 16 produces output voltage proportional to the intake air flow amount. The output voltage is input to the input port 36 via a corresponding AD converter 38. The air-fuel ratio sensor 23 produces output voltage approximately proportional to the air-fuel ratio of exhaust gas passing through the exhaust manifold 19, as shown in FIG. 2, based on the concentration of oxygen contained in the exhaust gas. Meanwhile, the oxygen sensor 24 produces output voltage that differs greatly depending on whether the air-fuel ratio of exhaust gas passing through the exhaust pipe 22, that is, exhaust gas after passing through the three-way catalyst 20, is richer or leaner than the stoichiometric air-fuel ratio (about 14.7), as shown in FIG. 3, based on the concentration of oxygen contained in the exhaust gas. These output voltages are input to the input port 36 via corresponding AD converters 38.

A load sensor 41 is connected to an accelerator pedal 40. The load sensor 41 produces output voltage proportional to the amount of displacement of the accelerator pedal 40. The output voltage is input to the input port 36 via a corresponding AD converter 38. A crank angle sensor 42 produces an output pulse each time a crankshaft rotates by 30 degrees, for example. The output pulse is input to the input port 36. The CPU 35 calculates the engine speed based on the output pulse of the crank angle sensor 42. The output port 37 is connected to the ignition plug 10, the fuel injection valve 11, and the step motor 17 via corresponding drive circuits 39.

The three-way catalyst 20 described above has oxygen storage capability. With this capability, the three-way catalyst 20 can store oxygen contained in the exhaust gas flowing into it, when the air-fuel ratio of the exhaust gas is lean. Also, the three-way catalyst 20 oxidizes and purifies HC and CO contained in the exhaust gas flowing into it by releasing the oxygen stored therein, when the air-fuel ratio of the exhaust gas is rich.

In order to effectively utilize the oxygen storage capability of the three-way catalyst 20, it is necessary to maintain the amount of oxygen stored in the three-way catalyst 20 at a predetermined amount (for example, half of the maximum oxygen storage amount) so that the exhaust gas can be purified irrespective of whether the air-fuel ratio of the exhaust gas thereafter will be rich or lean. If the amount of oxygen stored in the three-way catalyst 20 is maintained at the predetermined amount, the three-way catalyst 20 can always store and release a certain amount of oxygen. As a result, the three-way catalyst 20 can always oxidize and reduce components contained in the exhaust gas. Thus, in this embodiment, air-fuel ratio control is performed so as to maintain the amount of oxygen stored in the three-way catalyst 20 at a constant level, in order to maintain the exhaust purification performance of the three-way catalyst 20.

For this purpose, in this embodiment, the air-fuel ratio sensor 23 disposed upstream of the three-way catalyst 20 (upstream air-fuel ratio sensor) detects the exhaust air-fuel ratio (the ratio of air and fuel supplied to the exhaust passage upstream of the three-way catalyst 20, the combustion chamber 5 and the intake passage), and F/B control is performed on the amount of fuel supplied from the fuel injection valve 11 such that the output value of the air-fuel ratio sensor 23 corresponds to the stoichiometric air-fuel ratio (this F/B control will hereinafter be referred to as "main F/B control"). In this way, it is possible to maintain the exhaust air-fuel ratio approximately at the stoichiometric air-fuel ratio and the amount of oxygen stored in the three-way catalyst at a constant level, thereby improving the exhaust emission.

The main F/B control will be specifically described below. In this embodiment, the desired amount of fuel to be supplied from the fuel injection valve 11 to each cylinder (hereinafter referred to as "target fuel supply amount") Qft(n) is calculated by the following equation (1).

$$Qft(n)=Mc(n)/AFT+DQf(n) \quad (1)$$

In the equation (1), "n" represents the number of times of calculation performed by the ECU 31. For example, Qft(n) represents the target fuel supply amount calculated in the n-th calculation (that is, at time "n"). Mc(n) represents the amount of air expected to have been inducted into each cylinder by the time the intake valve 6 closes (hereinafter referred to as "in-cylinder intake air amount"). The in-cylinder intake air amount Mc(n) is obtained based on a map or a calculation formula that is prepared beforehand experimentally or by calculation, and that has, as arguments, the engine speed "Ne" and the amount of air having flowed through the intake pipe 15 (hereinafter referred to as "intake pipe air flow amount") "mt", for example. This map or calculation formula is stored in the ROM 34 of the ECU 31. The in-cylinder intake air amount Mc(n) is calculated using the map or calculation formula based on the engine speed Ne and the intake pipe air flow amount "mt" detected during engine operation. AFT represents the target value of the exhaust air-fuel ratio, which is the stoichiometric air-fuel ratio (14.7) in this embodiment. DQf represents the fuel correction amount calculated with regard to the main F/B control to be described later. The fuel injection valve 11 injects an amount of fuel corresponding to the target fuel supply amount calculated in this way.

Unlike the above description, in which the in-cylinder intake air amount Mc(n) is calculated based on a map, etc., having the engine speed Ne and the intake pipe air flow amount "mt" as arguments, the in-cylinder intake air amount Mc(n) may be calculated otherwise, for example by a calculation formula based on the degree of opening of the throttle valve 18, the atmospheric pressure, etc.

Figure 4:
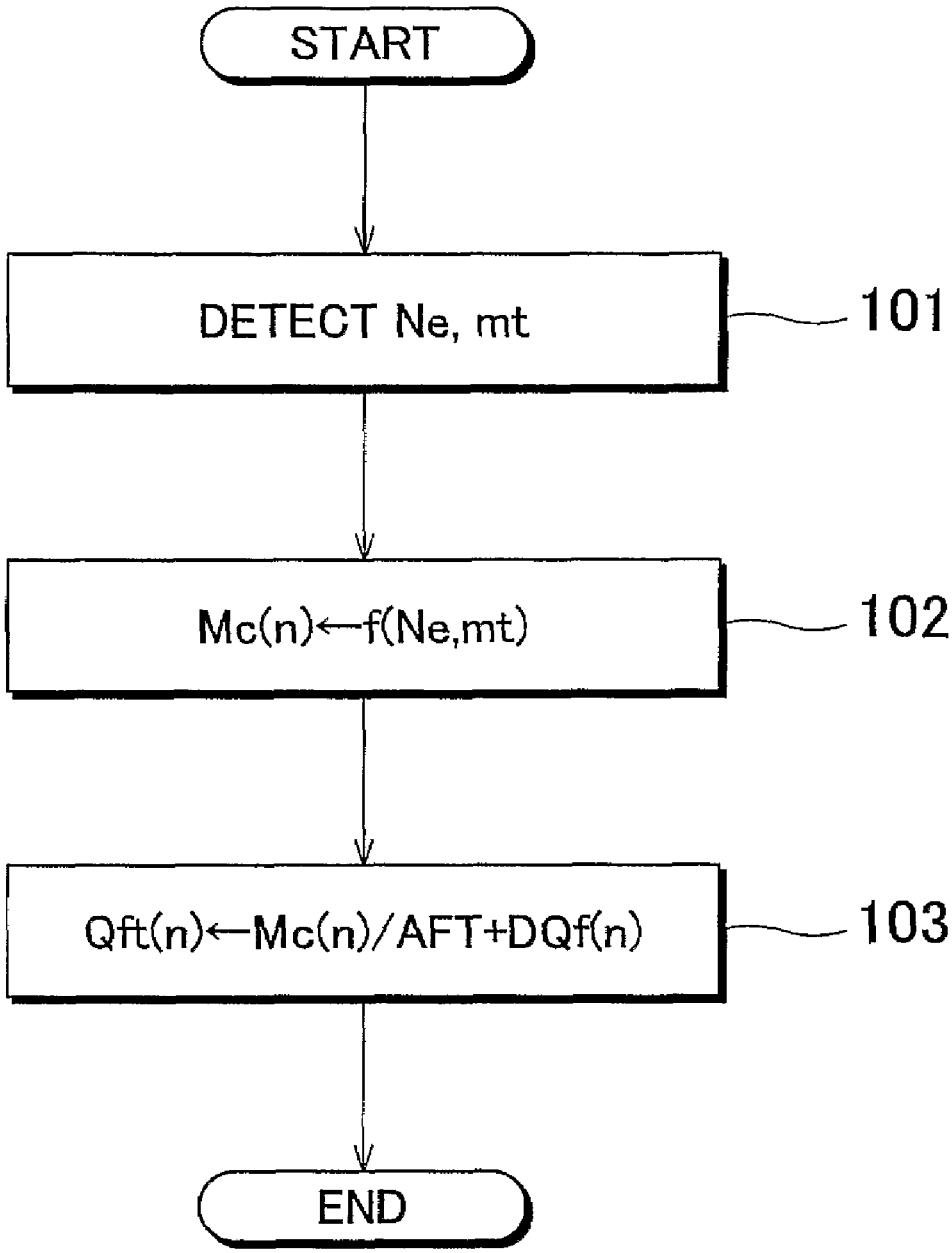
FIG. 4 is a flowchart showing a control routine for calculating the target fuel supply amount.

FIG. 4 is a flowchart showing a control routine for calculating the target fuel supply amount Qft(n) from the fuel injection valve 11. The control routine shown in the drawing is executed by interruption at predetermined time intervals.

In step 101, the engine speed Ne and the intake pipe air flow amount "mt" are detected by the crank angle sensor 42 and the air flow meter 16, respectively. Then, in step 102, the in-cylinder intake air amount Mc(n) in the n-th calculation is calculated based on the engine speed Ne and the intake pipe air flow amount "mt" detected in step 101, using a map or a calculation formula. Then, in step 103, the target fuel supply amount Qft(n) is calculated by the above equation (1) based on the in-cylinder intake air amount Mc(n) calculated in step 102 and the fuel correction amount DQf(n) in the n-th calculation calculated in the main F/B control to be described later. Then, the control routine is ended. The fuel injection valve 11 injects an amount of fuel equivalent to the target fuel supply amount Qft(n) calculated in this way.

Now, the main F/B control will be described. In the main F/B control of this embodiment, the air-fuel ratio deviation amount ΔAF, between the actual exhaust air-fuel ratio AFR calculated based on the output value of the air-fuel ratio sensor 23 and the target air-fuel ratio AFT, is calculated in each calculation, to calculate such a fuel correction amount DQf that brings the air-fuel ratio deviation amount ΔAF to zero. Specifically, the fuel correction amount DQf is calculated by the equation (2) below. That is, the F/B control in this embodiment to correct the fuel supply amount based on the air-fuel ratio deviation amount ΔAF is performed by PID control.

$$DQf(n) = DQf(n-1) + Kmp \cdot \Delta AF(n) + Kmi \cdot \sum_{k=1}^{n} \Delta AF(k) + Kmd \cdot (\Delta AF(n) - \Delta AF(n-1)) \quad (2)$$

In the above equation (2), DQf(n−1) represents the fuel correction amount in the (n−1)-th calculation, that is, in the preceding calculation. Also in the equation (2), Kmp·ΔAF(n), Kmi·ΣΔAF, and Kmd·(ΔAF(n)−ΔAF(n−1)) represent a proportional, an integral and a differential, respectively. In the following description, the values of the proportional, integral and differential will be referred to as "proportional correction value", "integral correction value", and "differential correction value", respectively. Kmp, Kmi and Kmd represent a proportional gain, an integral gain and a differential gain, respectively. These proportional gain Kmp, integral gain Kmi and differential gain Kmd may be predetermined fixed values, or may be values that are varied according to the engine operating condition.

In general, at cold startup of an internal combustion engine, startup fuel amount increase control is performed in which the amount of fuel to be supplied to the combustion chamber 5 is increased. This startup fuel amount increase control is performed to suppress deterioration of the combustion condition in the combustion chamber 5 at cold startup, due to the low temperature of the walls of the combustion chamber 5, etc., by increasing the amount of fuel to be supplied to the combustion chamber 5.

Figure 5:
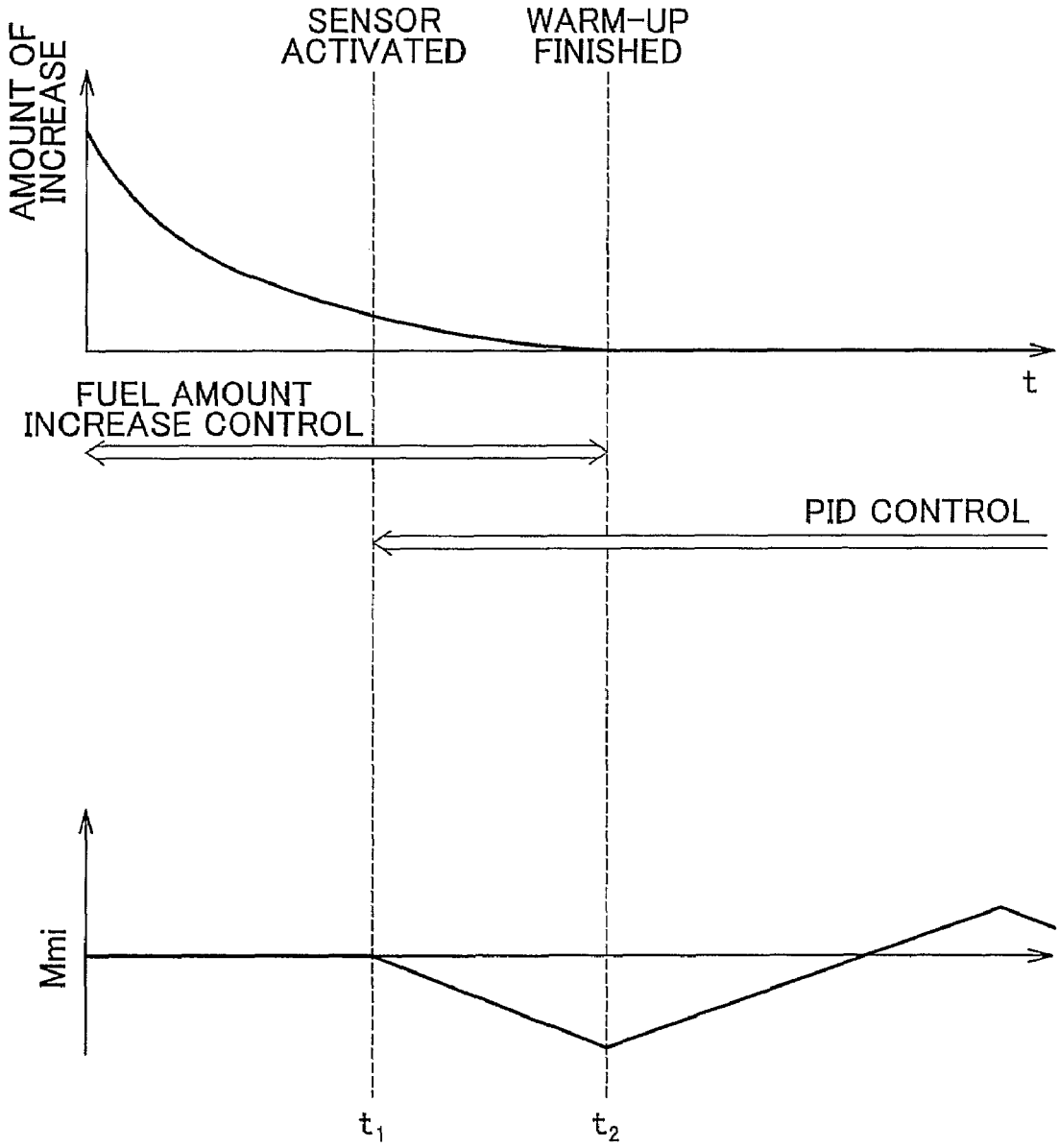
FIG. 5 is a time chart showing the amount of increase in fuel supply amount in startup fuel amount increase control and the integral correction value in PID control.

FIG. 5 is a time chart showing the amount of increase in fuel supply amount in startup fuel amount increase control and the integral correction value in PID control. As can be seen from the drawing, during the startup fuel amount increase control, the fuel supply amount is increased and the amount of increase is gradually decreased with the lapse of time. That is, as the temperature of the walls of the combustion chamber 5, etc., gradually increases with the lapse of time, accordingly the fuel supply amount is gradually decreased. Then, the amount of increase in fuel supply amount is brought to zero at time $t_2$, where the startup fuel amount increase control is finished.

Meanwhile, at cold startup of the internal combustion engine, the air-fuel ratio sensor 23 is not activated and thus cannot detect the exhaust air-fuel ratio. For this reason, in the related art, as shown in FIG. 5, the main F/B control is started at the same time as the air-fuel ratio sensor 23 is activated (at time $t_1$ of FIG. 5). In the case where the PID control is started at the same time as the air-fuel ratio sensor 23 is activated, the integration of the integral correction value in the PID control is started while the fuel supply amount is increased by the startup fuel amount increase control. During the startup fuel amount increase control, because the fuel supply amount is increased and thus the actual air-fuel ratio is far from the stoichiometric air-fuel ratio, the absolute value of the integral correction value increases abruptly as shown in FIG. 5. When the fuel amount increase control is finished, the absolute value of the integral correction value is significantly large and hence significantly diverted from the value expected to be achieved by the integral correction value during normal operation, for which the amount increase control is not performed.

In this case, the integral correction value does not reach an appropriate value immediately after the startup fuel amount increase control is finished, but it takes some time. For a period which the integral correction value has not achieved an appropriate value, it is difficult to control the actual air-fuel ratio to the stoichiometric air-fuel ratio also in the main F/B control. This deteriorates the exhaust emission for that period.

In this embodiment, at cold startup of the internal combustion engine, not the PID control but the PD control is performed immediately after the air-fuel ratio sensor 23 is activated during the startup fuel amount increase control, and the PID control is performed when a predetermined period elapses after the cold startup of the internal combustion engine. That is, even when the air-fuel ratio sensor 23 is activated, the integral correction value is not integrated but maintained at zero until the predetermined period elapses after the cold startup of the internal combustion engine, and the integration of the integral correction value is started when the predetermined period has elapsed.

Figure 6:
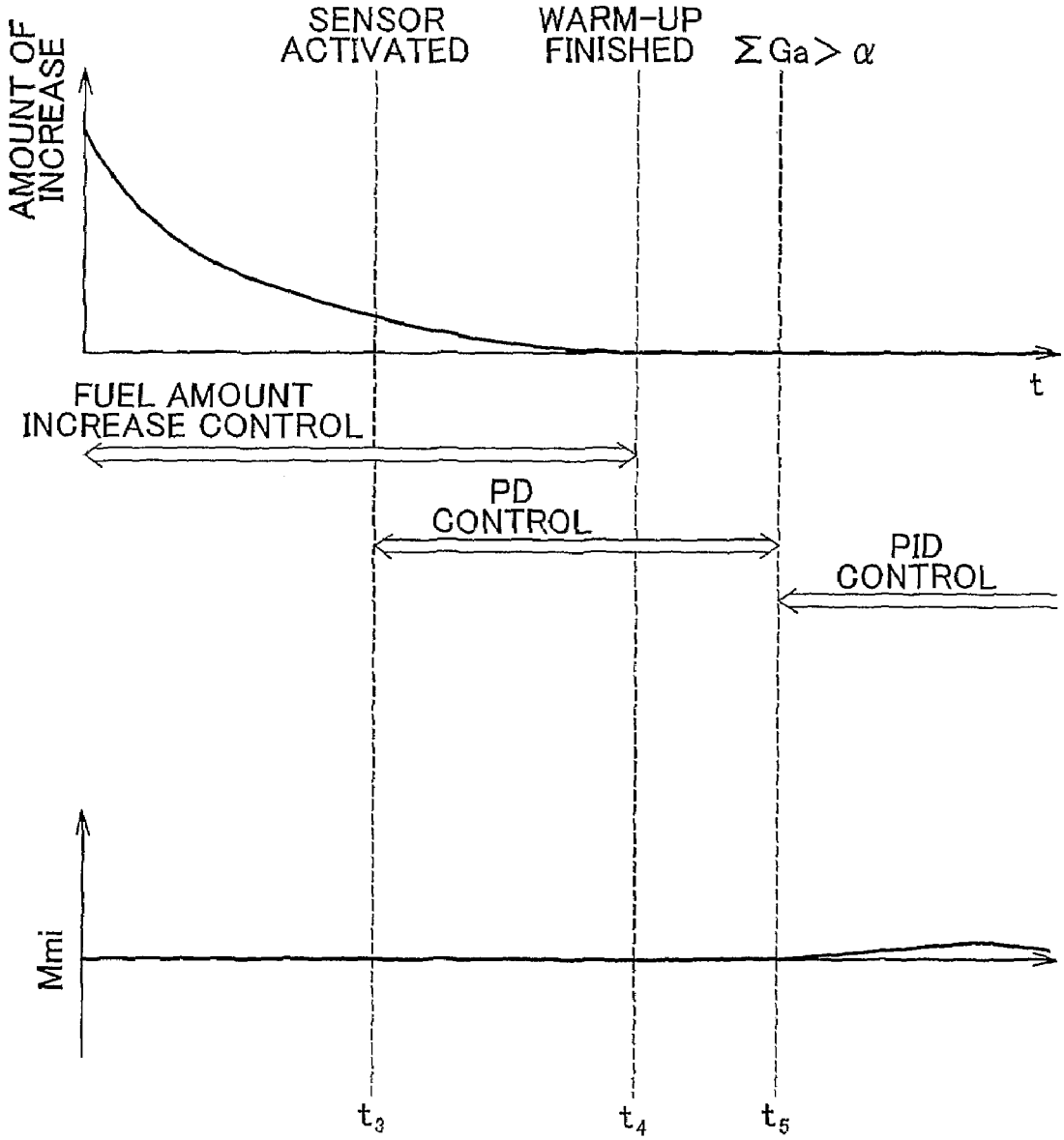
FIG. 6 is a time chart similar to FIG. 5, showing the amount of increase in fuel supply amount in the startup fuel amount increase control and the integral correction value in the PID control.

FIG. 6 is a time chart similar to FIG. 5, showing the amount of increase in fuel supply amount in the startup fuel amount increase control and the integral correction value in the PID control. As can be seen from the drawing, the PD control is performed from time $t_3$, at which the air-fuel ratio sensor 23 is activated, to time $t_5$, and the PID control is performed after time $t_5$. Thus, as shown in FIG. 6, the integral correction value is maintained at zero until time $t_5$, and integrated thereafter.

In this embodiment, the predetermined period is longer than the period from the cold startup of the internal combustion engine until the air-fuel ratio sensor 23 is activated. This ensures that the integration of the integral correction value is not started immediately after the main F/B control is started. As a result, the start of the integration of the integral correction value is delayed with respect to start of the main F/B control. The thus delayed start of the integration of the integral correction value prevents the absolute value of the integral correction value from becoming large while the actual air-fuel ratio is significantly diverted from the stoichiometric air-fuel ratio. This prevents the absolute value of the integral correction value from being significantly large when the startup fuel amount increase control is finished, thus suppressing deterioration of the exhaust emission.

Figure 7:
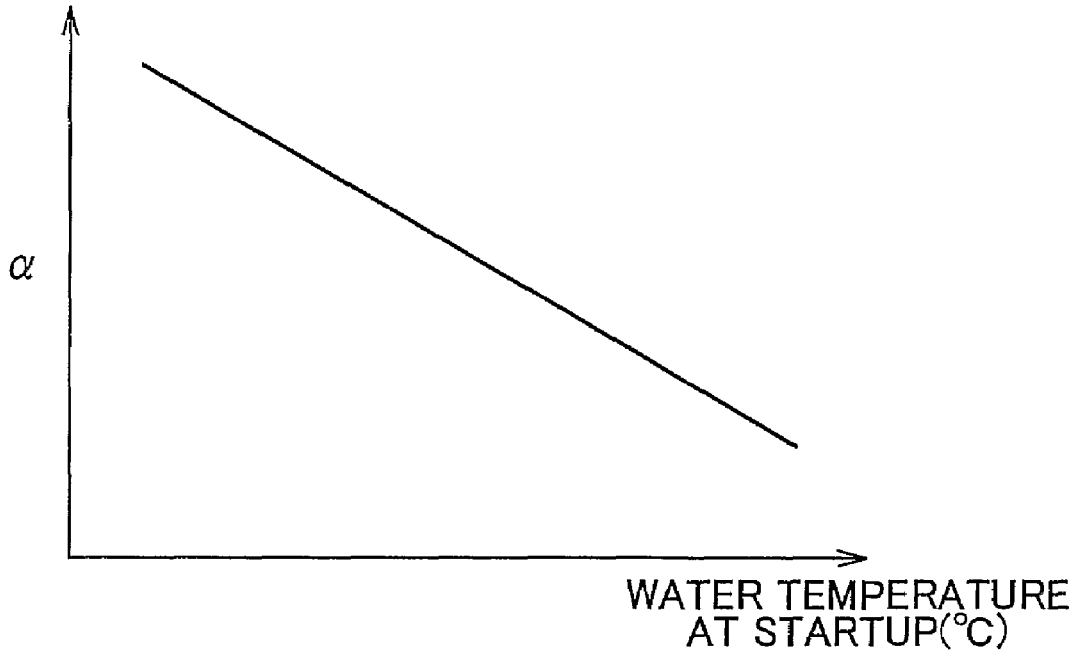
FIG. 7 is a chart showing the relationship between the engine coolant temperature at cold startup of the internal combustion engine and the reference value $\alpha$.

In this embodiment, the predetermined period is a period until the integral ΣGa of the intake air amount from the cold startup of the internal combustion engine becomes the reference value α or larger. The reference value α is varied according to the engine coolant temperature at the cold startup of the internal combustion engine. As shown in FIG. 7, the reference value α is larger when the startup coolant temperature is lower, and smaller when higher. Thus, in the case where the engine coolant temperature at the cold startup of the internal combustion engine is lower, that is, in the case where the startup fuel amount increase control is performed over a longer period, the larger reference value α results in a longer predetermined period. On the contrary, in the case where the engine coolant temperature at the cold startup of the internal combustion engine is higher, that is, in the case where the startup fuel amount increase control is performed over a shorter period, the smaller reference value α results in a shorter predetermined period.

In the example shown in FIG. 6, the integration of the integral correction value is started (at time $t_5$) after the startup fuel amount increase control is finished (at time $t_4$). However, the integration of the integral correction value may be started before the startup fuel amount increase control is finished. Also in such a case, the start of the integration of the integral correction value is delayed with respect to the activation of the sensor, thus suppressing deterioration of the exhaust emission.

Figure 8:
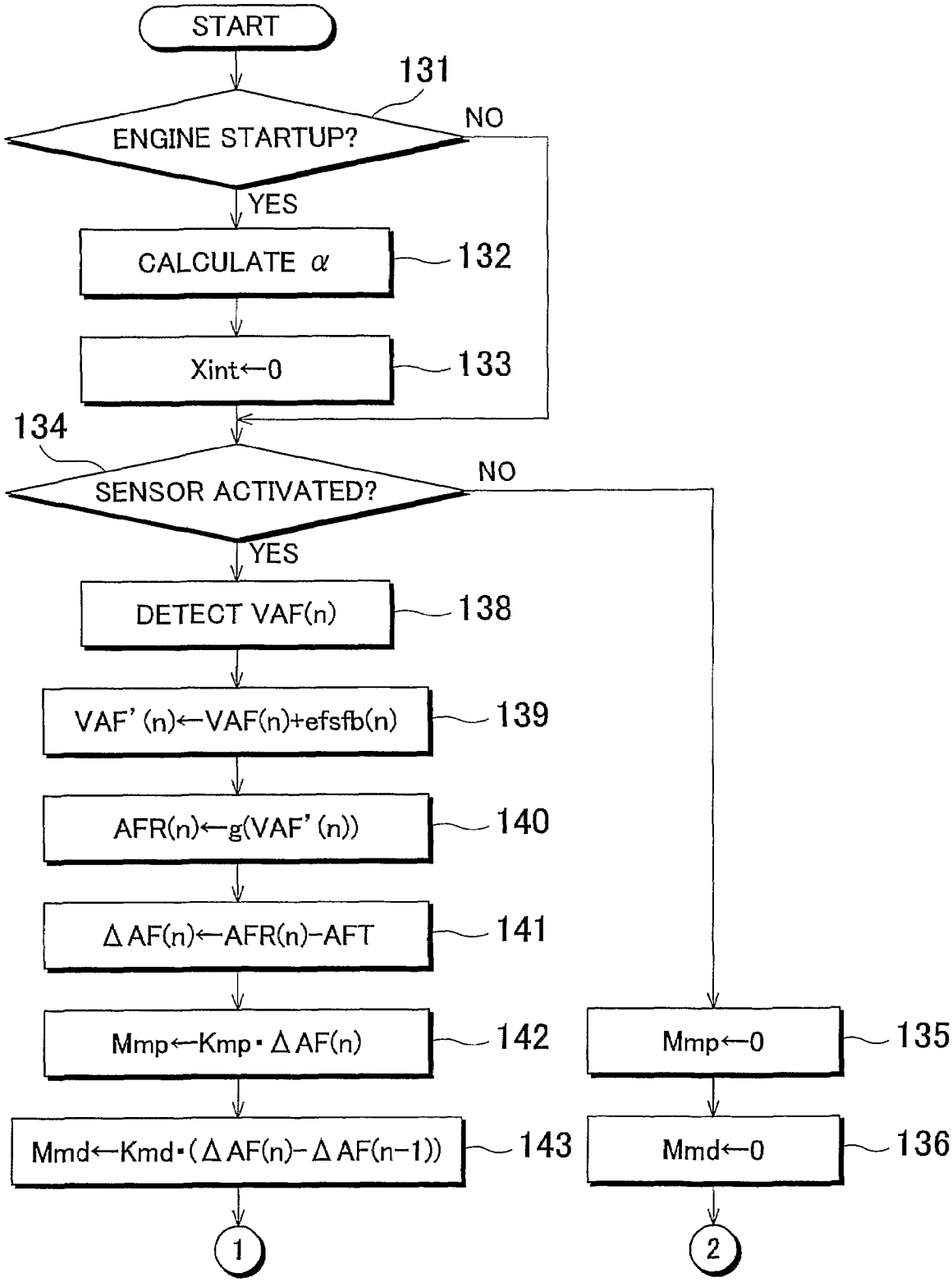
FIG. 8 is a first part of a flowchart showing a control routine for calculating the fuel correction amount in main F/B control.
Figure 9:
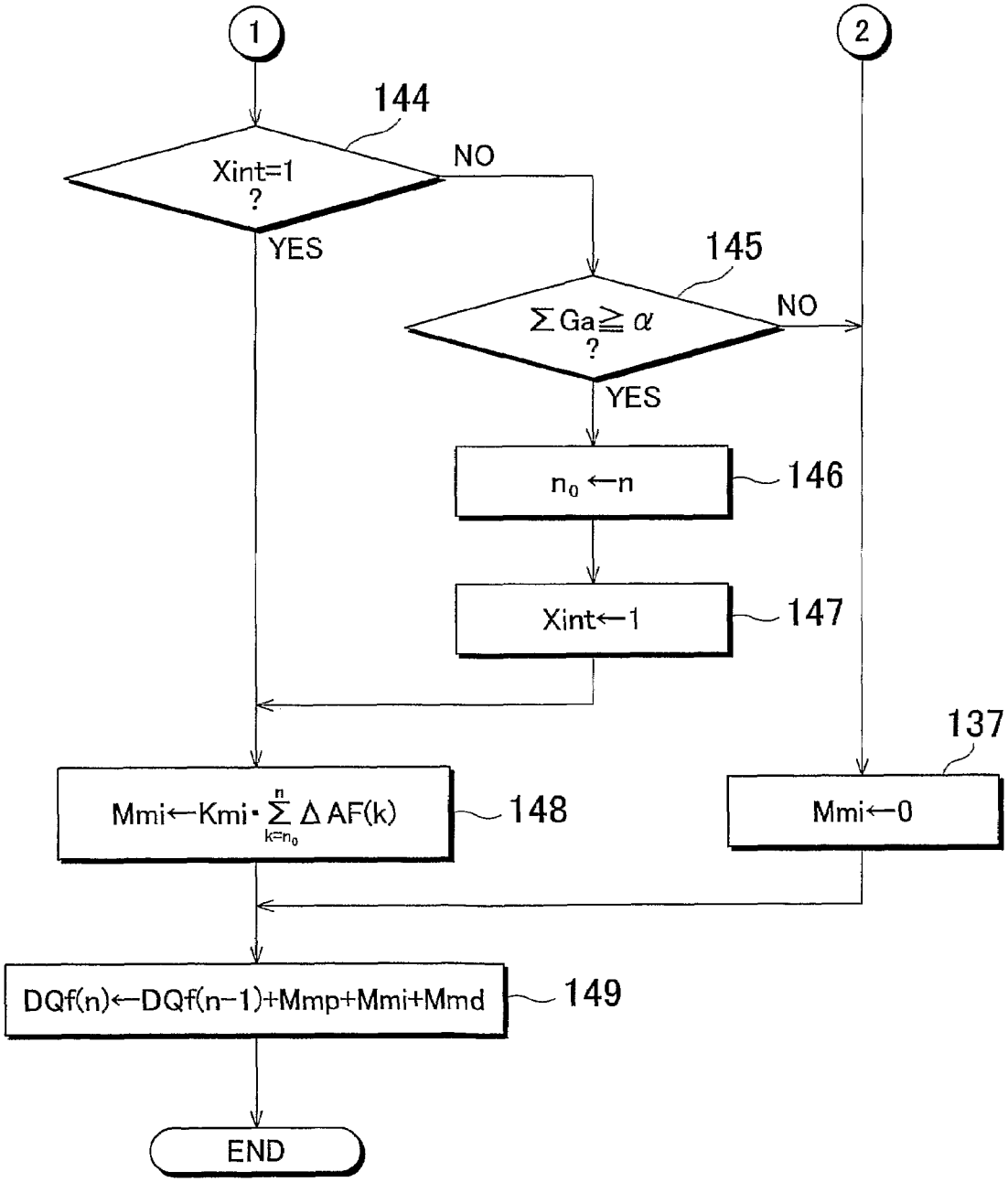
FIG. 9 is a second part of the flowchart showing the control routine for calculating the fuel correction amount in the main F/B control.

FIGS. 8 and 9 are flowcharts showing a control routine for calculating the fuel correction amount DQf in the main FIB control of this embodiment. The control routine shown in the drawings is executed by interruption at constant time intervals.

As shown in FIGS. 8 and 9, in step 131, it is determined whether or not the internal combustion engine is at startup. It is determined that the internal combustion engine is at startup when the ignition key is turned on, for example. If it is determined in step 131 that the internal combustion engine is at startup, the process proceeds to step 132. In step 132, the reference value α is calculated based on the engine coolant temperature at the startup of the internal combustion engine using the map shown in FIG. 7. Then, in step 133, the integral flag Xint is set to zero. The integration flag Xint is set to "1" while the integration of the integral correction value is performed, and to zero while not. On the other hand, if it is determined in step 131 that the internal combustion engine is not at startup, steps 132 and 133 are skipped.

Then, in step 134, it is determined whether or not the air-fuel ratio sensor 23 has been activated. If it is determined that the air-fuel ratio sensor 23 has not been activated, the process proceeds to steps 135, 136 and 137, where the proportional correction value Mmp, the differential correction value Mmd, and the integral correction value Mmi are set to zero, respectively. Thus, the main F/B control is not started, and the control routine is ended.

On the other hand, if it is determined in step 134 that the air-fuel ratio sensor 23 has been activated, the process proceeds to step 138. In step 138, the output value VAF(n) of the air-fuel ratio sensor 23 in the n-th calculation is detected. Then, in step 139, the output correction value efsfb(n) for the air-fuel ratio sensor 23 is added to the output value VAF(n) detected in step 138, to calculate the corrected output value VAF'(n) by correcting the output value of the air-fuel ratio sensor 23 (VAF'(n)=VAF(n)+efsfb(n)). The output correction value efsfb(n) is calculated by the control routine of the sub-F/B control to be described later.

Then, in step 140, the actual air-fuel ratio AFR(n) in the n-th calculation is calculated based on the corrected output value VAF'(n) calculated in step 139, using the map shown in FIG. 2. The thus calculated actual air-fuel ratio AFR(n) generally coincides with the actual air-fuel ratio of the exhaust gas flowing into the three-way catalyst 20 at the time of the n-th calculation.

Then, in step 141, the target air-fuel ratio AFT (in this embodiment, the stoichiometric air-fuel ratio) is subtracted from the actual air-fuel ratio AFR(n) calculated in step 140 to obtain the air-fuel ratio deviation amount ΔAF(n) in the n-th calculation (ΔAF(n)=AFR(n)−AFT(n)).

Then, in step 142, the proportional gain Kmp for the main F/B control is multiplied by the air-fuel ratio deviation amount ΔAF(n) calculated in step 141 to obtain the proportional correction value Mmp (Mmp=Kmp·ΔAF(n)). In step 143, the differential gain Kmd for the main F/B control is multiplied by the value obtained by subtracting the air-fuel ratio deviation amount ΔAF(n−1) in the preceding calculation from the air-fuel ratio deviation amount ΔAF(n) in the current calculation, to obtain the differential correction value Mmd (Mmd=Kmd·(ΔAF(n)−ΔAF(n−1))).

Then, in step 144, it is determined whether or not the integration flag Xint is "1", that is, whether or not the integration of the integral correction value Mmi has already been started. If the integration of the integral correction value Mmi has not been started, in which case the integration flag Xint has been set to "0", it is determined that the integration flag Xint is not "1", and the process proceeds to step 145. In step 145, it is determined whether or not the integral ΣGa of the intake air amount is less than the reference value α calculated in step 132. If it is determined in step 145 that the integral ΣGa of the intake air amount is less than the reference value α, that is, that the predetermined period has not elapsed after the startup of the internal combustion engine, the process proceeds to step 137, where the integral correction value Mmi is set to zero, and the control routine is ended.

On the other hand, if it is determined in step 145 that the integral ΣGa of the intake air amount is not less than the reference value α, that is, that the predetermined period has elapsed after the startup of the internal combustion engine, the process proceeds to step 146. In step 146, the current number of times of calculation "n" is set as the number of times of calculation no at which the integration of the integral correction value Mmi is started. Then, the integral flag Xint is set to "1" in step 147, and the process proceeds to step 148.

In step 148, the integral correction value Mmi is calculated by the equation (3) below. Then, in step 149, as given by the equation (4) below, the proportional correction value Mmp calculated in step 142 or 135, the differential correction value Mmd calculated in step 143 or 136, and the integral correction value Mmi calculated in step 148 or 137 are added to the fuel correction amount DQf(n−1) in the preceding calculation, to obtain the fuel correction amount DQf(n) in the current calculation. In the subsequent control routines, it is determined in step 144 that the integration flag has been set to "1", and the process proceeds from step 144 to step 148.

$$Mmi = Kmi \cdot \sum_{k=n_0}^{n} \Delta AF(k) \tag{3}$$

$$DQf(n) = DQf(n-1) + Mmp + Mmi + Mmd \tag{4}$$

The output of the air-fuel ratio sensor 23 may deviate, for example because of deterioration of the air-fuel ratio sensor 23 due to the heat of the exhaust gas. In such a case, the air-fuel ratio sensor 23 that would normally produce output values as shown by the solid line in FIG. 2 produces output values as shown by the broken line in FIG. 2, for example. In the case where the output value of the air-fuel ratio sensor 23 deviates as described above, the air-fuel ratio sensor 23 produces, when the exhaust air-fuel ratio is leaner than the stoichiometric air-fuel ratio, the output voltage that would normally be produced when the exhaust air-fuel ratio is at the stoichiometric air-fuel ratio. In this embodiment, such deviation in output value of the air-fuel ratio sensor 23 is compensated by the sub-F/B control using the oxygen sensor (downstream air-fuel ratio sensor) 24, such that the output value of the air-fuel ratio sensor 23 corresponds to the actual exhaust air-fuel ratio.

As shown in FIG. 3, the oxygen sensor 24 can detect whether or not the exhaust air-fuel ratio is richer or leaner than the stoichiometric air-fuel ratio, with substantially no room for deviation in determination as to whether richer or leaner. The output voltage of the oxygen sensor 24 is low when the actual exhaust air-fuel ratio is lean, and high when rich. Thus, when the actual exhaust air-fuel ratio is approximately at the stoichiometric air-fuel ratio, that is, repetitively exceeds and falls below the stoichiometric air-fuel ratio, the output voltage of the oxygen sensor 24 repetitively shifts between a high value and a low value. From this point of view, in this embodiment, the output value of the air-fuel ratio sensor 23 is corrected such that the output voltage of the oxygen sensor 24 repetitively shifts between a high value and a low value.

Figure 10:
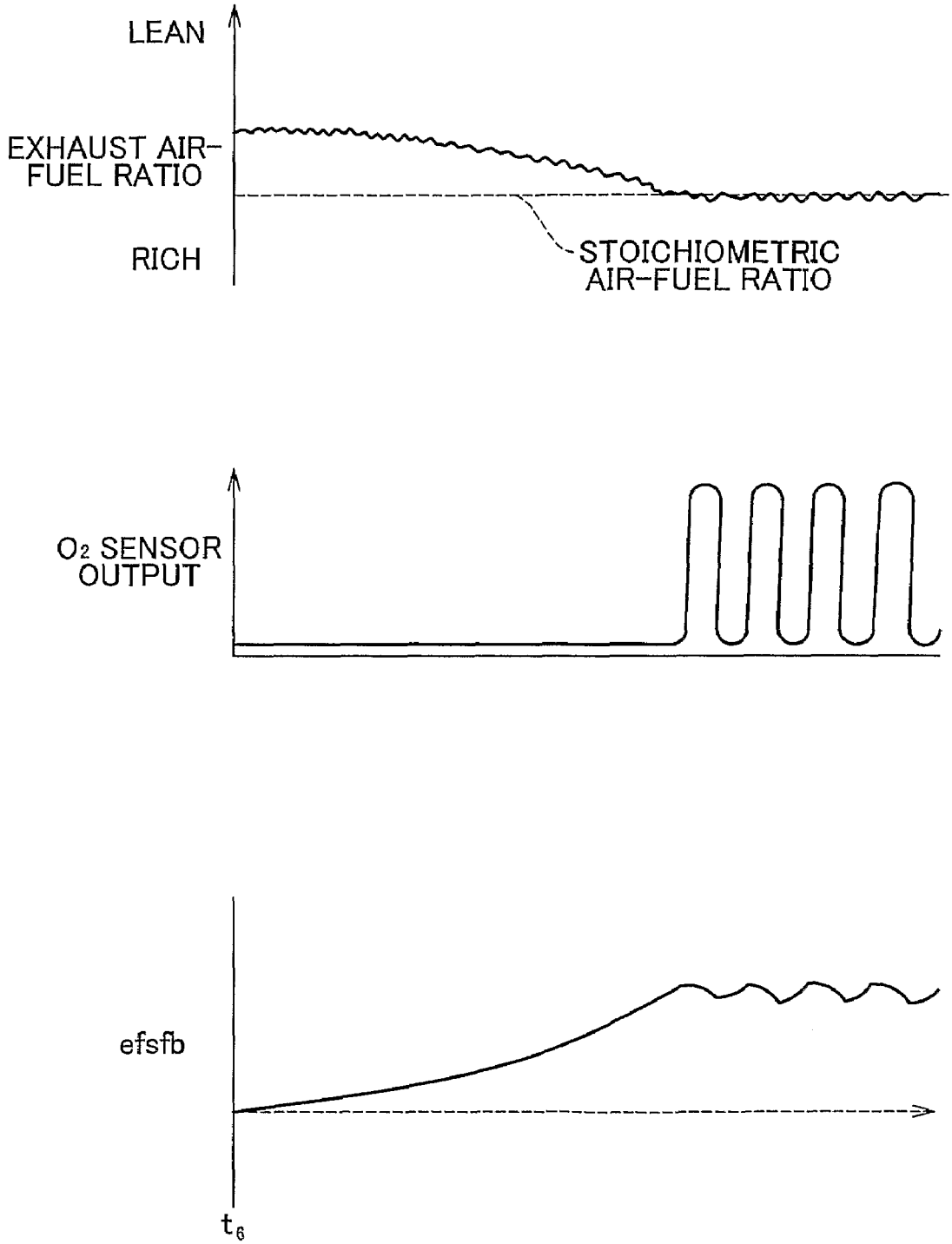
FIG. 10 is a time chart showing the actual exhaust air-fuel ratio, the output value of the oxygen sensor, and the output correction value for the air-fuel ratio sensor.

FIG. 10 is a time chart showing the actual exhaust air-fuel ratio, the output value of the oxygen sensor and the output correction value efsfb for the air-fuel ratio sensor 23. The time chart of FIG. 10 illustrates the state where deviation occurs in the air-fuel ratio sensor 23 and the actual exhaust air-fuel ratio is not at the stoichiometric air-fuel ratio, even though control is performed so as to bring the actual exhaust air-fuel ratio to the stoichiometric air-fuel ratio, and where such deviation is gradually compensated for.

In the example shown in FIG. 10, the actual exhaust air-fuel ratio is leaner than the stoichiometric air-fuel ratio at time $t_6$. This is because of the deviation in the air-fuel ratio sensor 23, which causes the air-fuel ratio sensor 23 to output a value corresponding to the stoichiometric air-fuel ratio when the actual exhaust air-fuel ratio is leaner than the stoichiometric air-fuel ratio. At this time, the oxygen sensor 24 outputs a low value.

As described above, in step 139 of FIG. 8, the output correction value efsfb for the air-fuel ratio sensor 23 is added to the output value VAF(n) to calculate the corrected output value VAF'(n). Thus, the output value of the air-fuel ratio sensor 23 is corrected to the leaner side when the output correction value efsfb is positive, and to the richer side when negative. As the absolute value of the output correction value efsfb is larger, the output value of the air-fuel ratio sensor 23 is corrected to a larger degree.

When the oxygen sensor 24 outputs a low value even though the output value of the air-fuel ratio sensor 23 is approximately at the stoichiometric air-fuel ratio, it is suggested that the output value of the air-fuel ratio sensor 23 has deviated to the richer side. Thus, in this embodiment, when the oxygen sensor 24 outputs a low value, the output correction value efsfb is increased to correct the output value of the air-fuel ratio sensor 23 to the leaner side. On the other hand, when the oxygen sensor 24 outputs a high value even though the output value of the air-fuel ratio sensor 23 is approximately at the stoichiometric air-fuel ratio, the output correction value efsfb is decreased to correct the output value of the air-fuel ratio sensor 23 to the richer side.

Specifically, the output correction value efsfb is calculated by the equation (5) below. In the equation (5) below, esfsb(n−1) represents the output correction value in the (n−1)-th calculation, that is, in the preceding calculation. Also in the equation (5), Ksp·ΔVO(n), Ksi·ΣΔVO and Ksd·(ΔVO(n)−ΔVO(n−1)) represent a proportional, an integral and a differential, respectively. Ksp, Ksi and Ksd represent a proportional gain, an integral gain and a differential gein, respectively. These proportional gain Ksp, integral gain Ksi, and differential gain Ksd may be predetermined fixed values, or may be values that are varied according to the engine operating condition. ΔVO(n) represents the output deviation amount between the output value of the oxygen sensor 24 in the n-th calculation and the target output value (in this embodiment, a value corresponding to the stoichiometric air-fuel ratio).

$$efsfb(n) = efsfb(n-1) + Ksp \cdot \Delta VO(n) + Ksi \cdot \sum_{k=1}^{n} \Delta VO(k) + Ksd \cdot (\Delta VO(n) - \Delta VO(n-1)) \tag{5}$$

As in the main F/B control described above, if the sub-F/B control is started at the same time as the oxygen sensor 24 is activated, the absolute value of the integral correction value becomes large, thus resulting in temporary deterioration of the exhaust emission.

In this embodiment, also in the sub-F/B control, at cold startup of the internal combustion engine, not the PID control but the PD control is performed immediately after the oxygen sensor 24 is activated during the startup fuel amount increase control, and the PID control is performed when a predetermined period elapses after the cold startup of the internal combustion engine. That is, even when the oxygen sensor 24 is activated, the integral correction value is not integrated but maintained at zero until the predetermined period elapses after the cold startup of the internal combustion engine, and the integration of the integral correction value is started when the predetermined period has elapsed.

In this embodiment, also in the sub-F/B control, the predetermined period is a period until the integral ΣGa of the intake air amount from the cold startup of the internal combustion engine becomes the reference value α' or larger. The reference value α' is varied according to the engine coolant temperature at the cold startup of the internal combustion engine. As with the reference value α shown in FIG. 7, the reference value α' is larger when the startup coolant temperature is lower, and smaller when higher. In this embodiment, the reference value α' in the sub-F/B control is equal to the reference value α in the main F/B control. However, the reference values may not necessarily be equal to each other, and may be different from each other.

Figure 11:
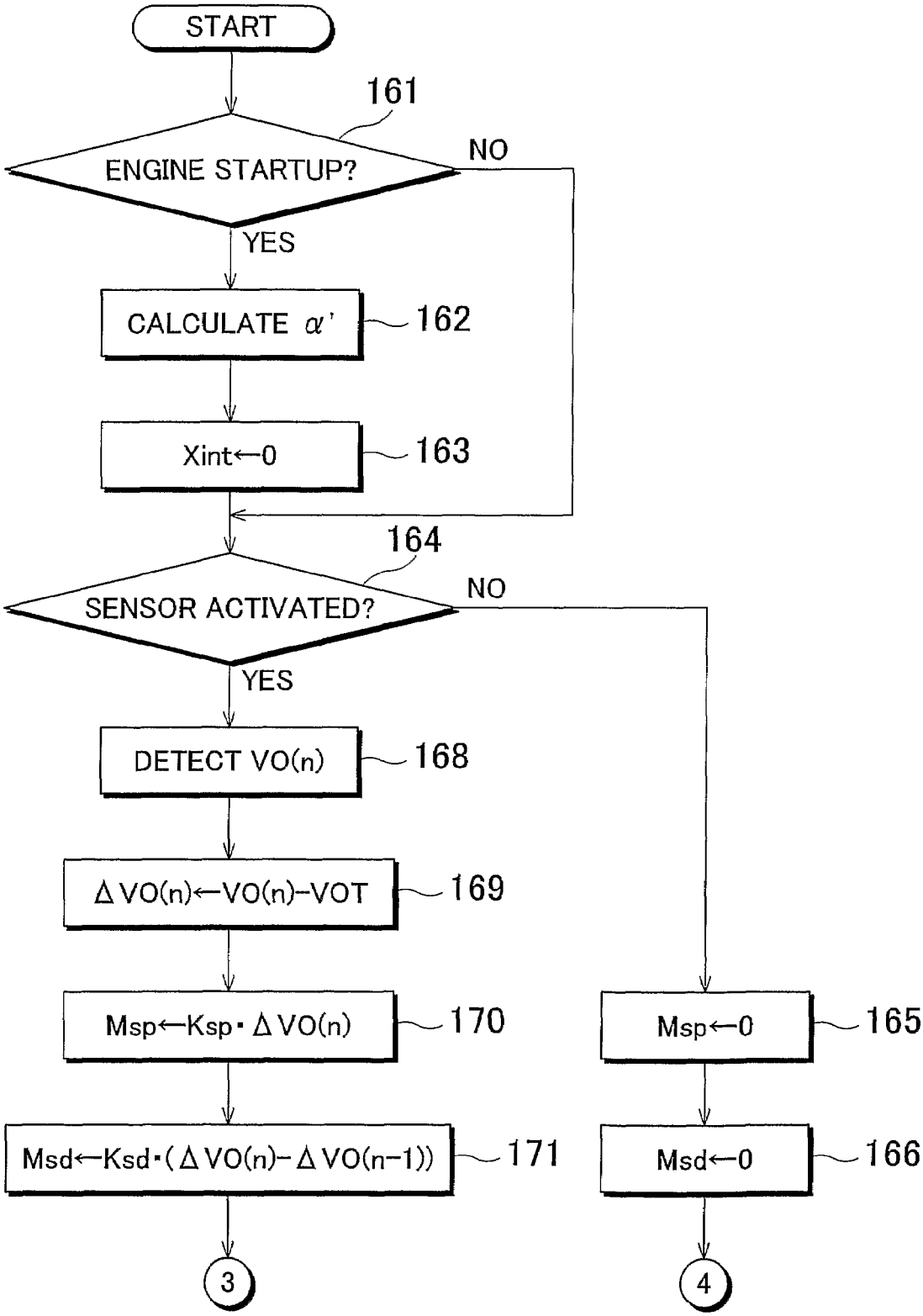
FIG. 11 is a first part of a flowchart showing a control routine for calculating the output correction value for the air-fuel ratio sensor in sub-F/B control of the first embodiment.
Figure 12:
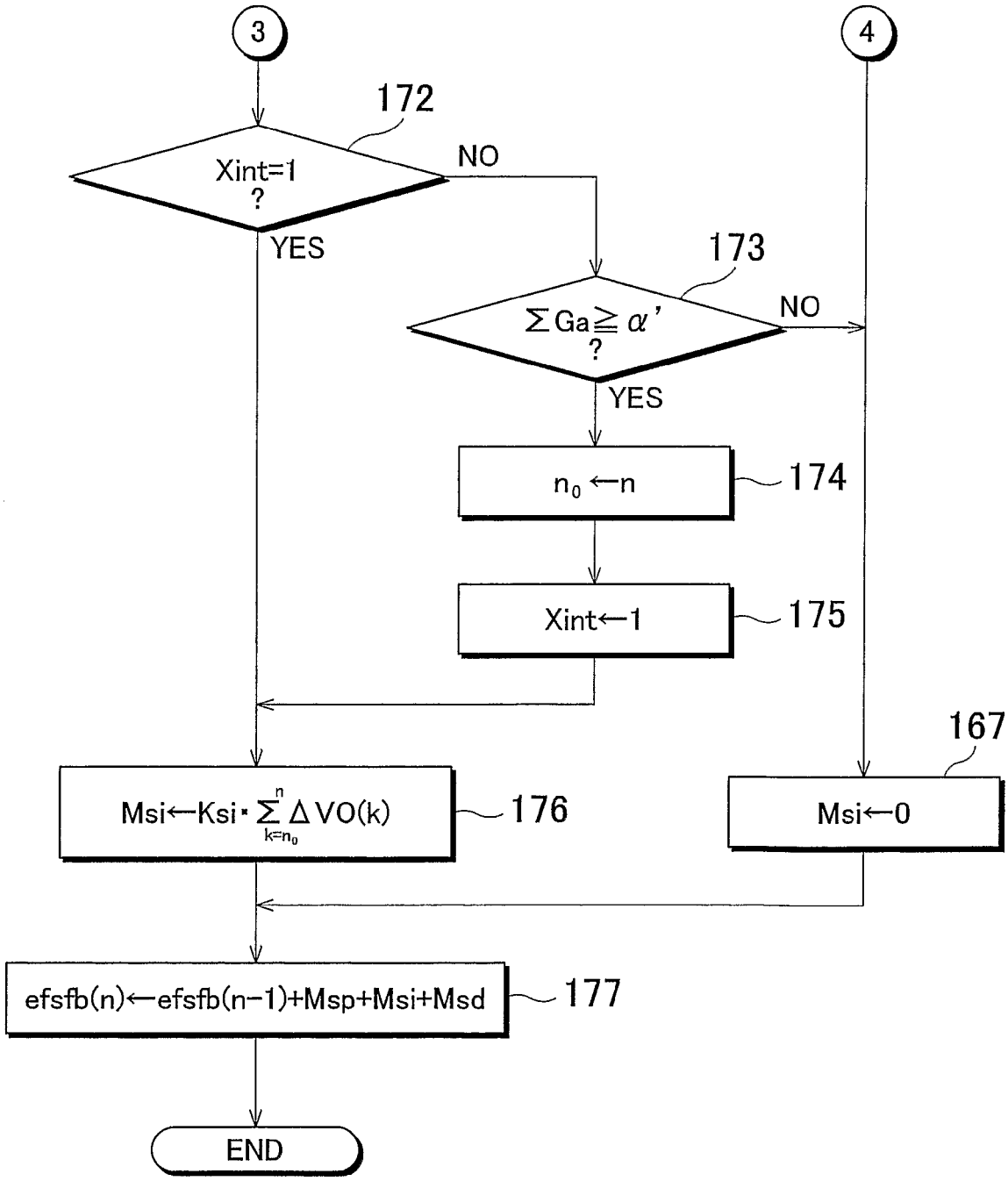
FIG. 12 is a second part of the flowchart showing the control routine for calculating the output correction value for the air-fuel ratio sensor in the sub-F/B control of the first embodiment.

FIGS. 11 and 12 are flowcharts showing a control routine for calculating the output correction value efsfb for the air-fuel ratio sensor 23 in the sub-F/B control of this embodiment. The control routine shown in the drawings is executed by interruption at constant time intervals.

Because the control routine of the sub-F/B control shown in FIGS. 11 and 12 are similar to that of the main F/B control shown in FIGS. 8 and 9, steps in the former similar to those in the latter will not be described again in the following description.

As shown in FIGS. 11 and 12, if it is determined in step 164 that the oxygen sensor 24 has been activated, the process proceeds to step 168. In step 168, the output value VO(n) of the oxygen sensor 24 in the n-th calculation is detected. Then, in step 169, the target output value VOT of the oxygen sensor 24 (in this embodiment, a value corresponding to the stoichiometric air-fuel ratio) is subtracted from the output value VO(n) calculated in step 168 to obtain the output deviation amount ΔVO(n) in the n-th calculation (ΔVO(n)=VO(n)−VOT).

Then, in step 170, the proportional gain Ksp for the sub-F/B control is multiplied by the output deviation amount ΔVO(n) calculated in step 169 to obtain the proportional correction value Msp (Msp=Ksp·ΔVO(n)). Then, in step 171, the differential gain Ksd for the sub-F/B control is multiplied by the value obtained by subtracting the output deviation amount ΔVO(n−1) in the preceding calculation from the output deviation amount ΔVO(n) in the current calculation, to obtain the differential correction value Msd (Msd=Ksd·(ΔVO(n)−ΔVO(n−1))).

In step 176, the integral correction value Msi is calculated by the equation (6) below. Then, in step 177, as given by the equation (7) below, the proportional correction value Msp calculated in step 170 or 165, the differential correction value Msd calculated in step 171 or 166, and the integral correction value Msi calculated in step 176 or 167 are added to the output correction value efsfb(n−1) in the preceding calculation, to obtain the output correction value efsfb(n) in the current calculation.

$$Msi = Ksi \cdot \sum_{k=n_0}^{n} \Delta VO(k) \tag{6}$$

$$efsfb(n) = efsfb(n-1) + Msp + Msi + Msd \tag{7}$$

Until a predetermined period elapses after cold startup of the internal combustion engine, the integral correction value is not at all integrated but maintained at zero, in the above embodiment. However, the integral correction value may be integrated as long as the integrated integral correction value is modified to be smaller than that during normal operation. In this case, the integral correction value Mmi in the main F/B control is calculated by the equation (8) below, for example, until the predetermined period elapses after the cold startup of the internal combustion engine. In the equation (8), "k" is a coefficient from 0 to 1 (0<k<1). To calculate the integral correction value Mmi after the predetermined period has elapsed after the cold startup of the internal combustion engine, the air-fuel ratio deviation amount ΔAF calculated before the predetermined period elapses after the cold startup is integrated after being multiplied by the coefficient "k", while the air-fuel ratio deviation amount ΔAF calculated after the predetermined period has elapsed is integrated without being multiplied by the coefficient "k".

$$Mmi = Kmi \cdot \sum_{k=1}^{n} k \cdot \Delta AF(k) \tag{8}$$

That is, even if the air-fuel ratio deviation amount ΔAF between the actual exhaust air-fuel ratio and the target air-fuel ratio is large, the integral correction value Mmi can be modified to be relatively small by multiplying the air-fuel ratio deviation amount ΔAF by the coefficient "k". This prevents the absolute value of the integral correction value from being large when the fuel amount increase control is finished, thus suppressing deterioration of the exhaust emission.

In the above embodiment, the PID control is performed for the main F/B control and the sub-F/B control. However, the PI control or other control may be performed instead of the PID control, as long as the integral control is included.

In the above embodiment, the exhaust purification catalyst is a three-way catalyst. However, the exhaust purification catalyst is not limited thereto, and may be any catalyst having oxygen storage capability, for example an $NO_x$ storage reduction catalyst having $NO_x$ storage capability.

In the above embodiment, the start of the integration of the integral correction value is delayed while the fuel amount increase control is performed at cold startup of the internal combustion engine. Fuel amount increase control to increase the fuel supply amount compared to that during normal operation of the internal combustion engine includes, besides the fuel amount increase control at cold startup, high-temperature amount increase control performed to cool the exhaust purification catalyst when the temperature thereof is significantly high, and power amount increase control performed to increase the engine output when the engine load is high. Thus, the above embodiment may be applied not only to the fuel amount increase control at cold startup, but also to such other types of amount increase control. In the latter case, the integration of the integral correction value is stopped at the same time as the amount increase control is started, and restarted after a predetermined period elapses after the amount increase control is started, for example.

Now, a description will be made of an air-fuel ratio control system of a second embodiment of the present invention. The configuration of the air-fuel ratio control system of the second embodiment is basically similar to that of the air-fuel ratio control system of the first embodiment, and thus will not be described again.

In the air-fuel ratio control system of the above first embodiment, the integral correction value is not integrated until the integral ΣGa of the intake air amount after cold startup of the internal combustion engine becomes the reference value α or larger. In the air-fuel ratio control system of the second embodiment, the integral correction value is not integrated until the integral ΣGa of the intake air amount after the amount increase control is finished becomes the reference value β or more.

Here, the atmosphere of the exhaust gas in the three-way catalyst 20 when the startup fuel amount increase control is performed will be discussed. During the startup fuel amount increase control, the air-fuel ratio of the exhaust gas flowing into the three-way catalyst 20 is basically rich, and thus the atmosphere of the exhaust gas in the entire three-way catalyst 20 is rich. After that, however, even when the startup fuel amount increase control is finished and the air-fuel ratio of the exhaust gas flowing into the three-way catalyst 20 has become lean, for example, the atmosphere of the exhaust gas in the three-way catalyst 20 does not become lean all at once, but becomes lean gradually from the upstream side of the three-way catalyst 20. Thus, even after the startup fuel amount increase control is finished, it takes some time for the atmosphere in the entire three-way catalyst 20 to become uniform with that of the exhaust gas flowing into the three-way catalyst 20.

When the atmosphere in the entire three-way catalyst 20 is not uniform with that of the exhaust gas flowing into the three-way catalyst 20, the oxygen sensor 24 disposed downstream of the three-way catalyst 20 cannot appropriately detect the exhaust air-fuel ratio. Thus, the oxygen sensor 24 does not output an appropriate value until the atmosphere in the entire three-way catalyst 20 becomes uniform with that of the exhaust gas flowing into the three-way catalyst 20. If the integral correction value is integrated before such total uniformity is achieved, it takes some time for the integral correction value to reach an appropriate value, thus deteriorating the exhaust emission.

In this embodiment, at cold startup of the internal combustion engine, not the PID control but the PD control is performed immediately after the oxygen sensor 24 is activated during the startup fuel amount increase control, and the PID control is performed when a predetermined period elapses after the startup fuel amount increase control is finished. That is, even when the oxygen sensor 24 is activated, the integral correction value is not integrated but maintained at zero until the predetermined period elapses after the startup fuel amount increase control is finished, and the integration of the integral correction value is started when the predetermined period has elapsed.

In this embodiment, the predetermined period is a period until the integral ΣGa of the intake air amount after the startup fuel amount increase control is finished becomes the reference value β or larger. The reference value β is a predetermined fixed value, for example a value corresponding to the amount of air normally necessary for the atmosphere in the entire three-way catalyst 20 to become uniform with the exhaust gas flowing into the three-way catalyst 20.

Figure 13:
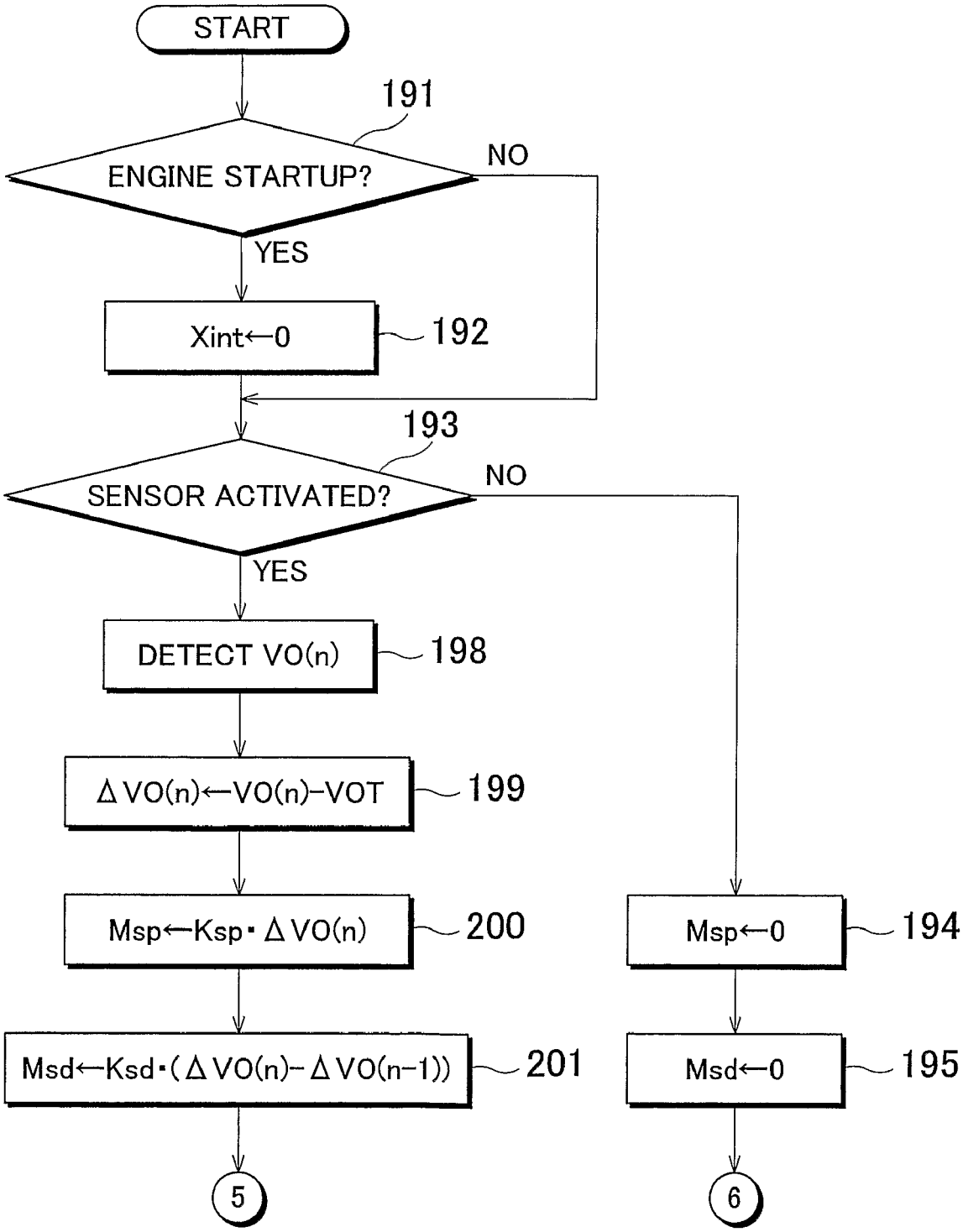
FIG. 13 is a first part of a flowchart showing a control routine for calculating the output correction value for the air-fuel ratio sensor in sub-F/B control of a second embodiment.
Figure 14:
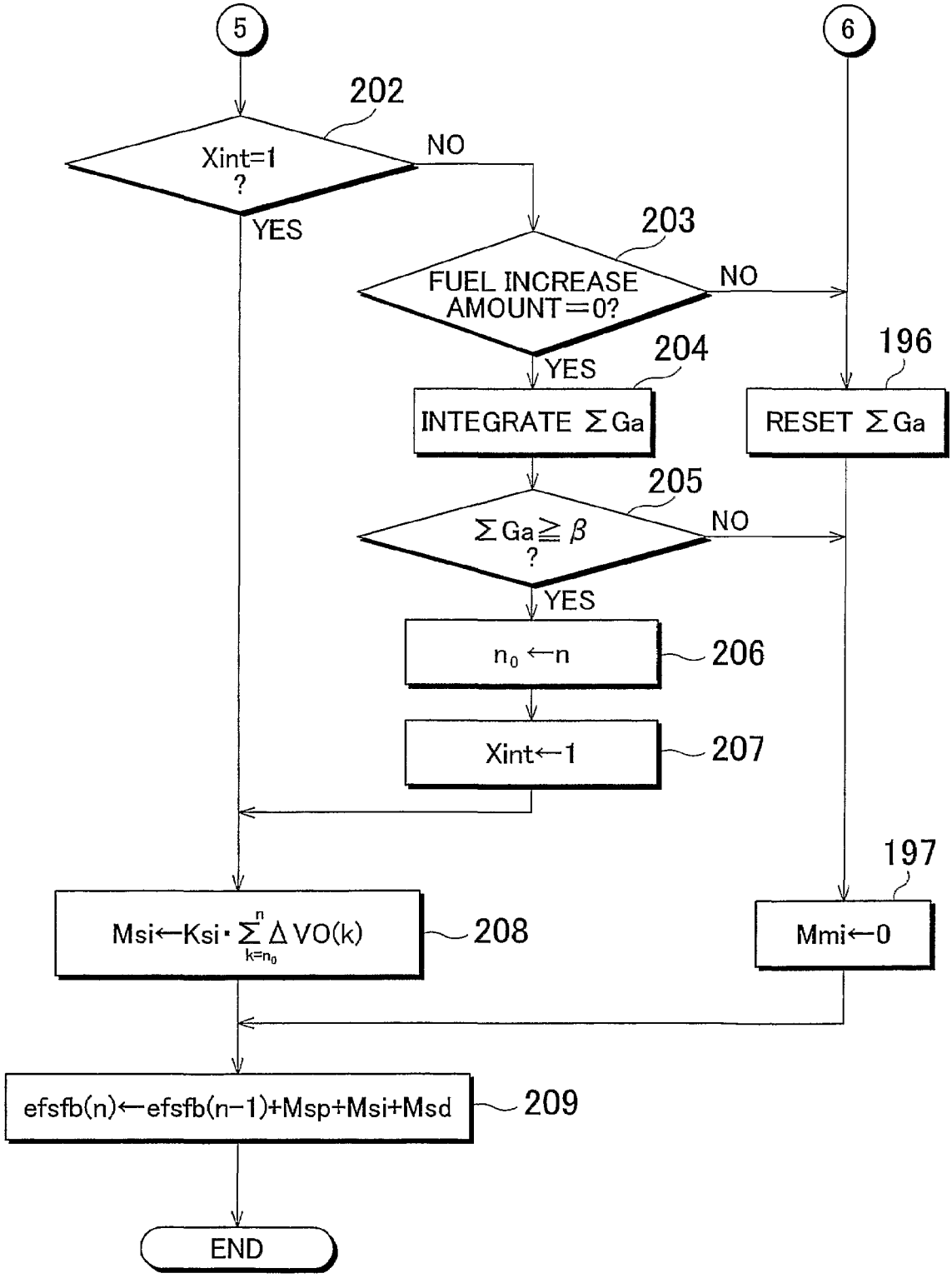
FIG. 14 is a second part of the flowchart showing the control routine for calculating the output correction value for the air-fuel ratio sensor in the sub-F/B control of the second embodiment.

FIGS. 13 and 14 are flowcharts showing a control routine for calculating the output correction value efsfb for the air-fuel ratio sensor 23 in the sub-F/B control of the second embodiment. The control routine shown in the drawings is executed by interruption at constant time intervals.

Steps 191 to 201 are similar to steps 161 to 171 shown in FIGS. 11 and 12, and will not be described again.

In step 202, it is determined whether or not the integration flag Xint is "1", that is, whether or not the integration of the integral correction value Msi has already been started. If the integration of the integral correction value Msi has not been started, in which case the integration flag Xint has been set to "0", it is determined that the integration flag Xint is not "1", and the process proceeds to step 203. In step 203, it is determined whether or not the amount of increase by the startup fuel amount increase control is zero, that is, whether or not the startup fuel amount increase control has been finished. If it is determined in step 203 that the startup fuel amount increase control has not been finished, the process proceeds to step 196. In step 196, the integral ΣGa of the intake air amount is reset to zero. Then, in step 197, the integral correction value Msi is set to zero.

On the other hand, if it is determined in step 203 that the startup fuel amount increase control has been finished, the process proceeds to step 204. In step 204, the integral ΣGa of the intake air amount after the startup fuel amount increase control is finished is updated. Then, in step 205, it is determined whether or not the integral ΣGa of the intake air amount calculated in step 204 is less than the reference value β, that is, whether or not the predetermined period has elapsed after the startup fuel amount increase control is finished. If it is determined that the integral ΣGa is less than the reference value β, the process proceeds to step 197, where the integral correction value Msi is set to zero.

On the other hand, if it is determined in step 205 that the integral ΣGa is not less than the reference value 13, the process proceeds to step 206. In step 206, the current number of times of calculation "n" is set as the number of times of calculation no at which the integration of the integral correction value Msi is started. Then, the integral flag Xint is set to "1" in step 207, and the process proceeds to step 208.

In step 208, the integral correction value Msi is calculated by the equation (6) above. Then, in step 209, the output correction value efsfb(n) is calculated by the equation (7) above. Then, the control routine is ended. In the subsequent control routines, it is determined in step 202 that the integration flag has been set to "1", and the process proceeds from step 202 to step 208.

While the invention has been described with reference to what are considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single element, are also within the scope of the appended claims.

The invention claimed is:

1. An air-fuel ratio control system for an internal combustion engine, comprising:

an air-fuel ratio sensor disposed upstream or downstream of an exhaust purification catalyst provided in an engine exhaust passage to detect an air-fuel ratio of exhaust gas, the system being configured to perform feedback control of a fuel supply amount such that an output value of the air-fuel ratio sensor is controlled to a target air-fuel ratio, wherein the feedback control is performed by calculating a correction amount by summing up a value of a proportional and a value of an integral calculated based on a deviation between the output value of the air-fuel ratio sensor and the target air-fuel ratio, and correcting the fuel supply amount based on the obtained correction amount, and, at cold startup of the internal combustion engine, from the startup of the internal combustion engine until a predetermined period elapses, the value of the integral calculated based on the deviation is set to a value smaller than the value of the integral calculated based on the same deviation during normal operation, even when the air-fuel ratio sensor is activated during a startup fuel amount increase control which is performed at cold startup of the internal combustion engine, in which startup fuel amount increase control the fuel supply amount is increased compared to that during normal operation, the predetermined period being longer than a period from the startup of the internal combustion engine until the air-fuel ratio sensor is activated.

2. The air-fuel ratio control system for an internal combustion engine according to claim 1, wherein the predetermined period being longer than a period from the cold startup until the startup fuel amount increase control is finished.

3. The air-fuel ratio control system for an internal combustion engine according to claim 1, wherein the value smaller than the value of the integral term calculated during normal operation is zero.

4. The air-fuel ratio control system for an internal combustion engine according to claim 1, wherein the predetermined period is varied according to an integrated intake air amount.

5. The air-fuel ratio control system for an internal combustion engine according to claim 1, wherein while the value of the integral term calculated based on the deviation is set to a value smaller than the value of the integral calculated based on the same deviation during normal operation, the value of the proportional calculated based on the deviation is the same as the value of the proportional calculated based on the same deviation during normal operation.

6. An air-fuel ratio control system for an internal combustion engine, comprising:

an air-fuel ratio sensor disposed upstream or downstream of an exhaust purification catalyst provided in an engine exhaust passage to detect an air-fuel ratio of exhaust gas, the system being configured to perform feedback control of a fuel supply amount such that an output value of the air-fuel ratio sensor is controlled to a target air-fuel ratio, and to perform fuel amount increase control in which an amount of fuel to be supplied to the internal combustion engine is increased compared to that when the internal combustion engine is in normal operation according to an engine operating condition, wherein the feedback control is performed by calculating a correction amount by summing up a value of a proportional and a value of an integral calculated based on a deviation between the output value of the air-fuel ratio sensor and the target air-fuel ratio, and correcting the fuel supply amount based on the obtained correction amount, and, from start of the fuel amount increase control until a predetermined period elapses, the value of the integral calculated based on the deviation is set to a value smaller than the value of the integral calculated based on the same deviation during normal operation even when the air-fuel ratio sensor is activated.

7. The air-fuel ratio control system for an internal combustion engine according to claim 6, wherein the predetermined period is longer than a period from start to finish of the fuel amount increase control.

8. The air-fuel ratio control system for an internal combustion engine according to claim 6, wherein the value smaller than the value of the integral term calculated during normal operation is zero.

9. The air-fuel ratio control system for an internal combustion engine according to claim 6, wherein the predetermined period is varied according to an integrated intake air amount.

10. The air-fuel ratio control system for an internal combustion engine according to claim 6, wherein while the value of the integral term calculated based on the deviation is set to a value smaller than the value of the integral calculated based on the same deviation during normal operation, the value of the proportional calculated based on the deviation is the same as the value of the proportional calculated based on the same deviation during normal operation.

11. A control method of an air-fuel ratio control system for an internal combustion engine that includes an air-fuel ratio sensor disposed upstream or downstream of an exhaust purification catalyst provided in an engine exhaust passage to detect an air-fuel ratio of exhaust gas, and that performs feedback control of a fuel supply amount such that an output value of the air-fuel ratio sensor is controlled to a target air-fuel ratio, characterized in that the feedback control comprising:

calculating a correction amount by summing up a value of a proportional and a value of an integral calculated based on a deviation between the output value of the air-fuel ratio sensor and the target air-fuel ratio, and correcting the fuel supply amount based on the obtained correction amount; and at cold startup of the internal combustion engine, from the startup of the internal combustion engine until a predetermined period elapses, setting the value of the integral calculated based on the deviation to a value smaller than the value of the integral calculated based on the same deviation during normal operation, even when the air-fuel ratio sensor is activated during a startup fuel amount increase control which is performed at cold startup of the internal combustion engine, in which startup fuel amount increase control the fuel supply amount is increased compared to that during normal operation, the predetermined period being longer than a period from the startup of the internal combustion engine until the air-fuel ratio sensor is activated.

12. A control method of an air-fuel ratio control system for an internal combustion engine that includes an air-fuel ratio sensor disposed upstream or downstream of an exhaust purification catalyst provided in an engine exhaust passage to detect an air-fuel ratio of exhaust gas, that performs feedback control of a fuel supply amount such that an output value of the air-fuel ratio sensor is controlled to a target air-fuel ratio, and that performs fuel amount increase control in which an amount of fuel to be supplied to the internal combustion engine is increased compared to that when the internal combustion engine is in normal operation according to an engine operating condition, the feedback control comprising:

calculating a correction amount by summing up a value of a proportional and a value of an integral calculated based on a deviation between the output value of the air-fuel ratio sensor and the target air-fuel ratio, and correcting the fuel supply amount based on the obtained correction amount; and from start of the fuel amount increase control until a predetermined period elapses, setting the value of the integral calculated based on the deviation to a value smaller than that calculated based on the same deviation during normal operation even when the air-fuel ratio sensor is activated.

* * * * *